United States Patent [19]

Hefti et al.

[11] Patent Number: 4,502,801

[45] Date of Patent: Mar. 5, 1985

[54] RIBBON CASSETTE FOR WORD PROCESSORS, PRINTERS AND TYPEWRITERS

[75] Inventors: Kurt Hefti, Zumikon; Stefan Wirth, Egg, both of Switzerland

[73] Assignee: Franz Büttner AG, Egg, Switzerland

[21] Appl. No.: 477,815

[22] Filed: Mar. 22, 1983

[30] Foreign Application Priority Data

Mar. 23, 1982 [CH] Switzerland ..... 1787/82

[51] Int. Cl.[3] ..... B41J 35/28

[52] U.S. Cl. ..... 400/208; 400/234

[58] Field of Search ..... 400/207, 208, 208.1, 400/234; 242/197, 198, 199, 200, 75.4

[56] References Cited

U.S. PATENT DOCUMENTS

| | | | |
|---|---|---|---|
| 810,895 | 1/1906 | Elmberg | 400/220 |
| 3,520,495 | 7/1970 | Sotani | 242/199 X |
| 3,528,626 | 9/1970 | Bumb, Jr. | 400/208 X |
| 4,010,839 | 3/1977 | Guerrini et al. | 400/207 |
| 4,299,504 | 11/1981 | Benz et al. | 400/208 |
| 4,350,451 | 9/1982 | Furrow | 400/208 |
| 4,368,992 | 1/1983 | Gagnebin | 400/234 X |
| 4,385,331 | 5/1983 | Schoettle et al. | 242/199 X |

FOREIGN PATENT DOCUMENTS

| | | |
|---|---|---|
| 2232773 | 1/1974 | Fed. Rep. of Germany . |
| 2840873 | 5/1979 | Fed. Rep. of Germany . |
| 590784 | 8/1977 | Switzerland . |

OTHER PUBLICATIONS

IBM Technical Disclosure Bulletin, vol. 18, No. 4, Sep. 1975, p. 1093, "Ribbon Drag Wire", by Lenney.

*Primary Examiner*—Edgar S. Burr
*Assistant Examiner*—Charles A. Pearson
*Attorney, Agent, or Firm*—Karl F. Ross; Herbert Dubno

[57] ABSTRACT

A typewriting or printer film ribbon cassette has a carrier with fixedly spaced pins forming axes for the takeup and supply spools so that, as the ribbon builds up on the takeup spool, the carrier is shifted away from a feed wheel whose axis is coplanar with the axes of the supply and takeup spools against the force of a spring urging the carrier in the opposite direction.

8 Claims, 10 Drawing Figures

RIBBON CASSETTE FOR WORD PROCESSORS, PRINTERS AND TYPEWRITERS

FIELD OF THE INVENTION

Our present invention relates to a film-type print-transfer ribbon cassette and, more particularly to a ribbon-replacement cassette for a typewriter or like printing machine ribbon.

BACKGROUND OF THE INVENTION

With the advent of word processing machinery, electronic typewriters, electric typewriters and printers for automatic data processing and for other purposes, it is increasingly of interest to facilitate the ribbon replacement or exchange and, for this purpose, ribbon cassettes have been developed.

Such cassettes generally comprise a supply spool for the ribbon which may be in the form of a synthetic resin film having a transfer layer which, when impacted against a sheet of paper supported by a platen, transfers color from the ribbon as defined by the impacting element which can be a daisy wheel, a printing head such as a spherical or cylindrical printing element, a thimble or the like carrying a font of type faces or even a dot matrix, pin or hammer head.

The cassette generally also comprises a takeup spool, a guide providing a path for the ribbon between the supply spool and the takeup spool and enabling the cassette to be inserted in the machine so that the ribbon is located between the print element and the platen, and a brake or like device for maintaining a substantially constant tension in the ribbon in the printing zone.

Cassettes of this type have been provided in recent years for all kinds of printing machines, including typewriters, teletypewriters, data printers, calculators and the like and are particularly effective because they allow rapid, clean and effortless replacement of the used ribbon.

To permit the ribbon to be utilized for a relatively long period, i.e. for many impacts and impressions before the cassette must be changed, the length of ribbon accommodated in the cassette must be large. On the other hand, it is desirable to provide a cassette with the smallest possible dimensions and weight so that storage is simplified, the machines may be made more compact and, in general, critical space about the printing head should not be obstructed by excessively large cassettes. In fact, many of the machines with which cassettes can be used are most desirable in particularly compact configurations.

Consequently, significant effort has been expended in attempts to develop extremely compact cassettes containing a large supply of the film ribbon. In one approach, as described in U.S. Pat. No. 4,010,839, the supply coil has an axis fixed in the cassette and the ribbon is fed from the latter to the takeup side of the cassette which has a takeup coil whose axis of rotation is displaced with increasing the diameter of this coil in a manner such that this axis is swung away from the center of the cassette by a lever pivoted on the cassette.

A second approach is disclosed in German open application No. 28 40 873 of May 23, 1979 which corresponds to an application Ser. No. 853,704 in the U.S. Patent and Trademark Office of Nov. 21, 1977. In this device, the takeup spool is rotatable on a carrier and is shifted together with the latter. The supply coil in this case is stationary.

Space saving is proposed in German open application No. 1,574,439 and the corresponding U.S. Pat. No. 3,520,495 with a tape cassette with a capstan arrangement for feeding the tape to a takeup spool which is coupled to a supply spool along an arcuate path so that as the takeup spool grows in size with collection of the spent ribbon, the two spools are displaced along an arcuate path defined by slots formed in the cassette and in which the connecting member is guided.

The arcuate slots are formed at the upper and lower faces of the cassette and the arcuate connecting member holds the axes and spindles of the spools in a predetermined spaced apart relationship.

The spacing between the two spools along this arcuate path thus need not be substantially greater than twice the radius of the full coil which can be formed on one of the spools so that the total length of the cassette need only be about four times the latter spool radius. This arrangement, however, requires capstan and control devices which lie largely outside the cassette and thus are prone to contamination when the cassette is used in the highly vulnerable and exposed environment of a printing machine.

It should be noted that the cassette of these latter references is not intended for use with typewriter or like ribbons but is provided for video or sound recording tapes for use in machines in which high contamination levels do not arise. Furthermore, the problem of maintaining a constant tension across a typewriting zone also does not arise in connection with such tapes since the machines are designed to maintain continuous and constant speeds at least in part by driving the supply spools. Certainly no friction system is advantageous in such arrangements (see page 11, the penultimate line of German open application No. 1, 574,439).

Disposable cassettes do not require means for enabling the return of the ribbon from the takeup spool to the supply spool. All that is necessary during the takeup of the ribbon is the maintenance of tension.

In U.S. Pat. No. 4,299,504, a system is described in which a drive wheel (star wheel) is located within the cassette and the supply spool is guided in a linear path by means of a spring to press against the takeup spool, the spring passing around the hub of the spool and engaging the cassette wall at a fixed location. This arrangement is intended to ensure a continuously tensioned typewriter ribbon.

The latter system has, however, the disadvantage that decreasing radius of the supply spool, the force on the spring and thus the tension of the ribbon in the typewriting zone increase and this change in tension can result in a variation in the characteristics of the imprint transferred to the paper. This appears to result from the fact that the drive wheel cannot be prevented from slipping against the ribbon as the drive torque which is necessary with higher tension increases.

OBJECTS OF THE INVENTION

It is the principal object of the present invention to provide a highly compact disposable typewriter ribbon cassette which avoids the disadvantages of the prior art unit described above and additionally provides advantages over these systems with respect to simplicity and constant ribbon tension.

Another object of this invention is to provide a film ribbon cassette for typewriting, printing and like machines which are capable of maintaining a constant tension in the typewriting zone, is economical to manufacture and is, above all, reliable and capable of delivering uniform character impressions over the entire length of the ribbon.

SUMMARY OF THE INVENTION

These objects and others which will become apparent hereinafter are attained, in accordance with the present invention, in a ribbon cassette for typewriters, printers and the like, utilizing a film ribbon, and having a carrier provided with two pins defining axes for a supply spool and a takeup spool, the pins being mutually parallel and at a fixed distance from one another, while being shiftable together on and with the carrier.

According to an important feature of the inventions, means is provided to transfer the pressing force of a drive wheel within the cassette of the takeup coil and to the carrier to thus shift the carrier as this coil builds up. By providing a fixed distance between the supply spool and the takeup spool, variations in friction between the ribbon and the drive wheel can be avoided. More specifically, the latter means may be spring connected pin carrier parallel to the longitudinal dimension thereof and drawing the takeup spool against the drive roller. The latter is preferably disposed so that its axis lies in a common plane with the axes of the takeup and supply spools, this latter plane including the longitudinal axis of the carrier if a longitudinal axis is provided, and being parallel to the spring.

When the carrier is a pivotal member, according to the invention, the axes of the pins and the axis of the wheel nevertheless are substantially coplanar with the spring forces being applied to the pivotal member so as to swing the latter against a force applied by the drive wheel to the takeup spool.

Another important feature of the invention is the brake for maintaining a substantially constant drag upon the supply spool, thereby ensuring a substantially constant tension in the ribbon.

This brake can be a loop brake surrounding the supply spool over at least a fraction of a turn and possibly in one or more turns and anchored at least in part on the carrier so that a substantially constant brake torque is applied to the supply spool and this torque remains uniform over the entire delivery of the ribbon. The brake, more generally, is entrained by the carrier so that it acts independently of its location in the housing to maintain the substantially constant brake torque.

The carrier and the pins can be guided for linear movement in grooves, slits or channels in the upper and lower walls of the cassette.

According to another embodiment of the invention, these channels can be provided with ramps for controlling the stress applied by the friction brake to the supply spool, thereby maintaining a constant braking torque upon the latter as the supply spool shifts along the channel with delivery of the ribbon.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
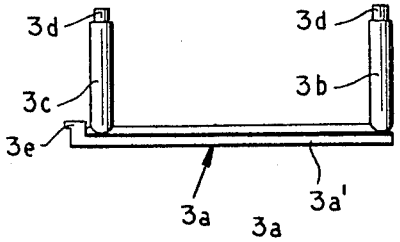
FIG. 1 is a side elevational view of a carrier for a cassette in accordance with the present invention.
Figure 2:
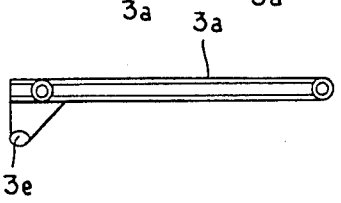
FIG. 2 is a plan view of this carrier.

In the embodiment of FIGS. 1 through 4, the spool carrier 3*a* has a bar 3*a'* formed with a pair of pins 3*b* and 3*c* and fabricated by, for example, metal die casting or synthetic resin injection molding.

The free ends 3*d* of the pins 3*b* and 3*c* are stepped down in diameter to form guide stubs which can be received in a longitudinal groove in the upper wall of the cassette. The carrier 3*a* is guided in a channel formed on the lower wall of the cassette.

The carrier 3*a* also is provided with a lug 3*e* to which a tension spring 4 can be anchored.

This spring 4 serves to shift the carrier and a supply spool and a takeup spool on the pins 3*c* and 3*b*, respectively to the right (FIG. 3) to bring the supply spool 6 to bear against a feed wheel 5 which is disposed within the cassette and is rotated by the ribbon advance mechanism. The feed wheel 5 is toothed to ensure substantially positive engagement with the ribbon 9. The supply spool is represented at 7.

Figure 3:
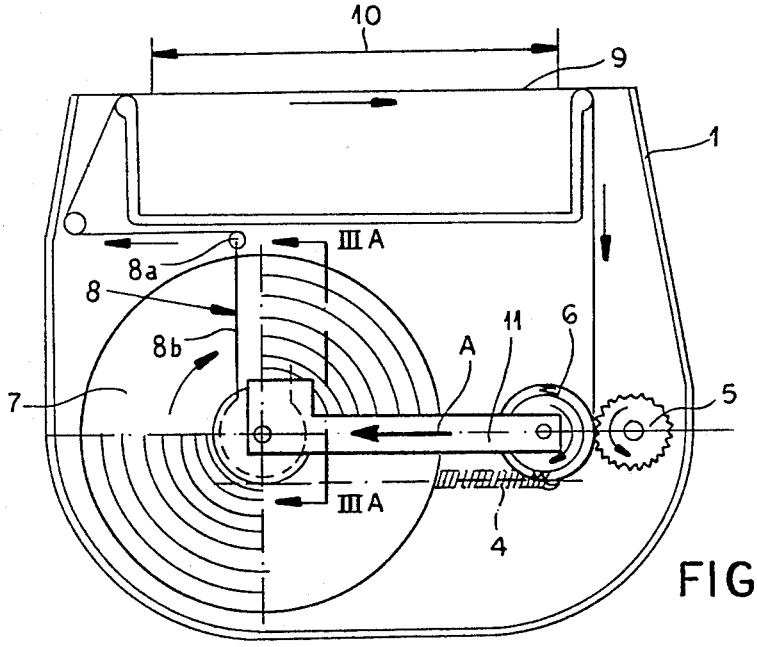
FIG. 3 is a plan view of an open cassette showing the supply spool and takeup spools in place as the supply of the ribbon commences.
Figure 4:
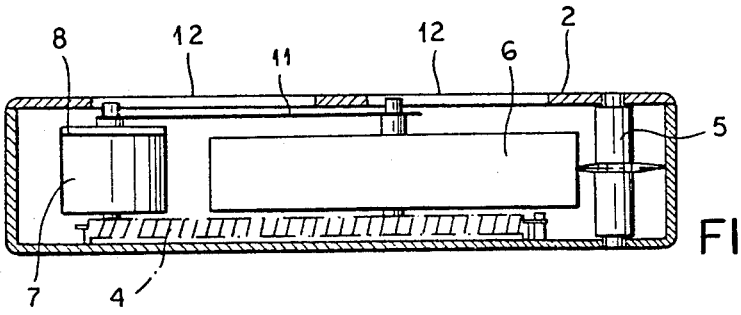
FIG. 4 is a longitudinal section through the cassette of FIG. 3 as the supply of ribbon is substantially completed.

As the coil of ribbon on the takeup spool 6 grows, with advance of the ribbon, the carrier is shifted longitudinally in the direction of the arrow A to the left (FIG. 3). In FIG. 4 we have shown the slots 12 in which the stubs 3*d* of the pins 3*c* and 3*b* are guided, thereby maintaining the pins, which form the vertical axes for the supply and takeup spools, in precise vertical orientation.

Figure 3A:
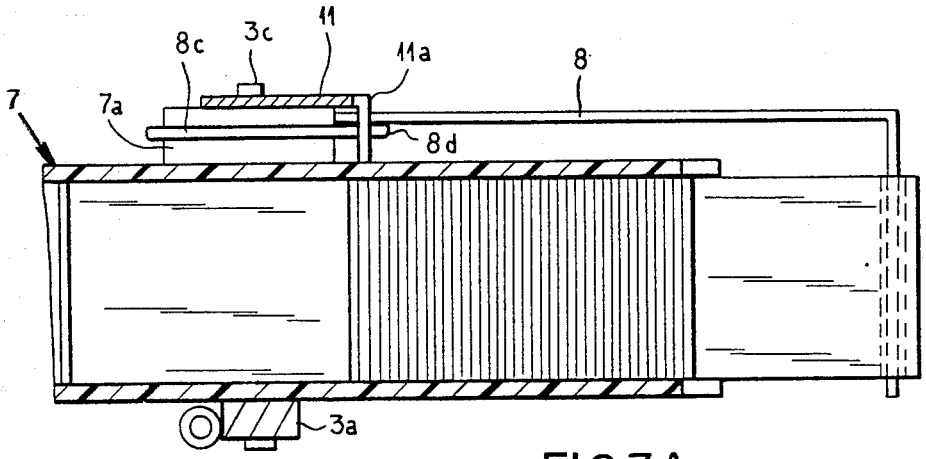
FIG. 3A is a section taken along the line IIIA—IIIA of FIG. 3, but drawn to a larger scale.

As the supply coil is shifted to the left, the loop brake 8 is also shifted to the left on the carrier. This brake ensures a constant tension of the ribbon 9 in the region of the typewriting zone. More specifically, the ribbon 9 can pass around a guide pin 8*a* carried on a free end of the loop brake 8, which is at least the better part of one turn 8*c* (FIG. 3*a*) passing around a cylindrical portion 7*a* of the supply spool 7. The other end of the brake loop at 8*d* is affixed to downwardly extending flange or plate 11*a* of an anchor member which mounts the loop brake upon the carrier 3*a*. The anchor member 11 may be a thin bar fitted over the stubs 3*d* (see FIG. 4). The member 11 thus prevents rotation of the loop brake 8.

It should be noted that loop brakes hitherto have been used as far as we are aware only in conjunction with nonshiftable axes and these earlier loop brakes have not been adaptable to a shiftable-axis system since in such a system the drag applied by the loop brake would immediately increase as the axis was shifted and thus generate an increased retardation which could vary tensions on the ribbon.

Instead of a toothed wheel 5, we may use a milled wheel or a wheel formed otherwise, e.g. by knurling, with formations ensuring positive engagement with the ribbon. The axis of this wheel is coplanar with the axes defined by the pins 3*b* and 3*c* and, as the spool which decreases progressively in diameter is moved toward one wall of the cassette (compare FIGS. 3 and 4), the axis of the other spool moves progressively away from the other wheel of the cassette.

The shaft of the feed wheel may be driven by any conventional means in the typewriter or printer.

Figure 5:
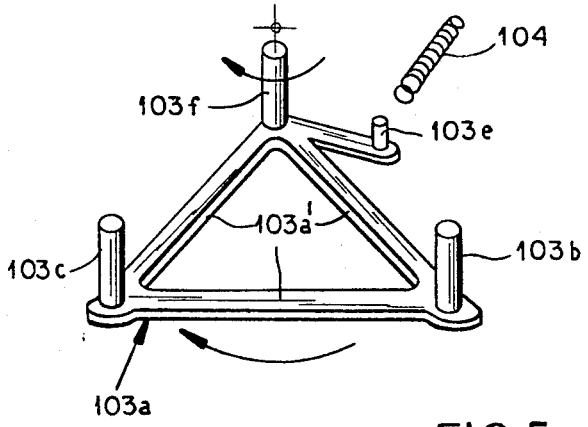
FIG. 5 is a perspective view of a pivotable carrier according to the invention.

In FIG. 5 we have shown an embodiment of the carrier 103*a* which has a triangular array of bars 103*a* carrying to pins 103*b* and 103*c* for the takeup and supply spools respectively and pivotally mounted in the cassette by a further pin 103*f*. A lug 103*e* is provided with still another pin engageable by a spring 104 in this embodiment, the carrier is swung in a clockwise sense by the build up of ribbon on the takeup spool and is biased in the opposite direction of the spring 104. This eliminates any need for linear guide structures in the housing or cover of the cassette. Note that a loop brake is provided in this embodiment in the manner described as well.

Figure 6:
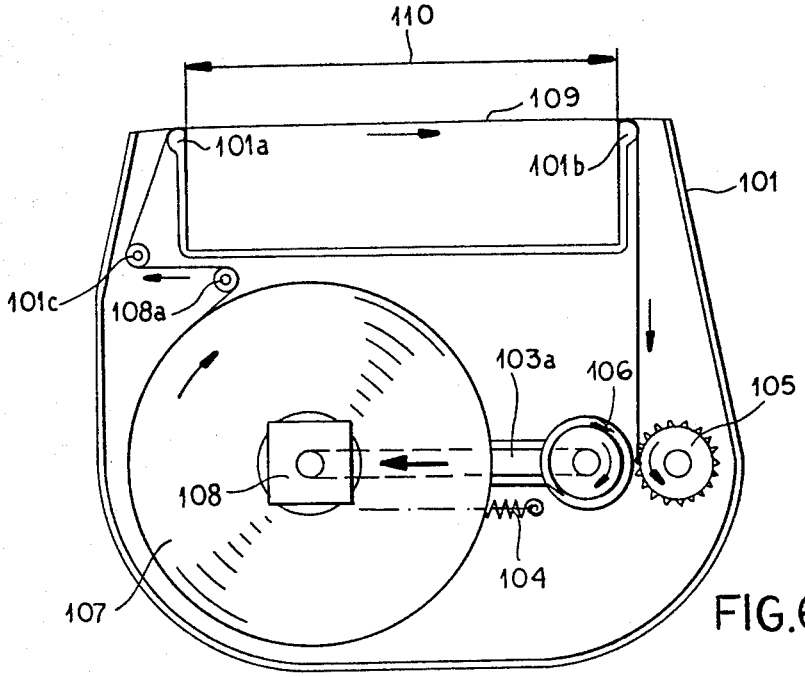
FIG. 6 is a view similar to FIG. 3 utilizing a longitudinally shiftable carrier but with a brake element to apply axial force.
Figure 7:
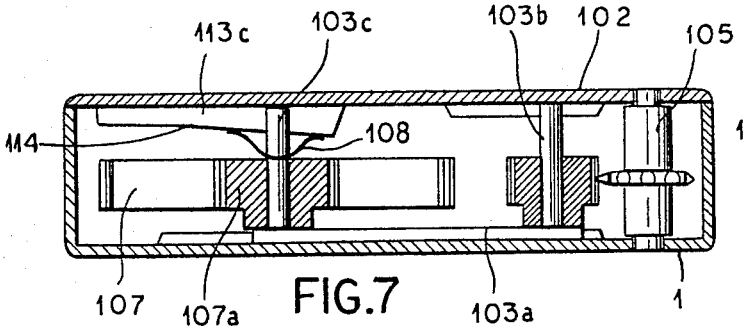
FIG. 7 is a longitudinal section through the cassette of FIG. 6.
Figure 7A:
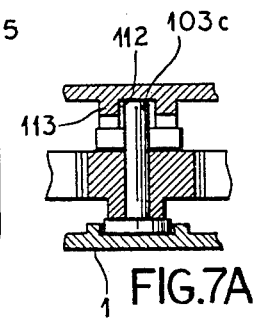
FIG. 7A is a transverse section through this cassette.

In FIGS. 6 and 7, the cassette 101, like the cassette 1 of FIG. 3, is provided with a pair of guide edges 101*a* and 101*b* which are spanned by the ribbon 109 in the stretch 110 at which printing occurs. Before the ribbon 109 is guided onto this stretch, however, it passes around a fixed pin 101*c*. Unlike the embodiment of FIG. 3, however, the ribbon also passes around a fixed pin 108*a* which is not connected with the tension-generating brake 108. In this embodiment, the tension-generating brake 108 bears axially upon the hub 107*a* of the supply spool 107, surrounds the pin 103*c*, and reacts against a bearing surface 114 formed by a pair of ramps 113 defining a guide channel 112 for the pin 103*c*. The pin 103*c*, like the pin 103*b* is fixed to the linear carrier 103*a* and the upper ends of the pins can also be guided in slots in the wall 102 of the cassette. A drive wheel 105 is here provided to advance the ribbon and wind it up upon the takeup coil 106 on pin 103*b* while the carrier 103 is urged to the right by a spring 104.

The ramp against which the friction brake 108 reacts provides an inclined surface which reduces the spring force as the carrier is shifted to the left (FIGS. 6 and 7), thereby maintaining a constant drag as the ribbon is delivered by the supply spool 107 and the diameter of the latter is reduced.

Figure 8:
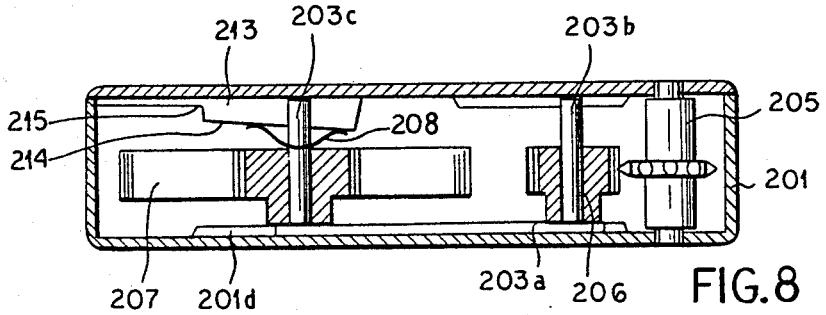
FIG. 8 is a longitudinal section similar to FIG. 7 but showing the seat for the brake spring in a stepped configuration.

In the embodiment of FIG. 8, the ramp 213 has a surface 214 against which the brake spring 208 reacts. Here the ramp is provided with a step 215 into which the spring 208 can pass to completely relax the braking force. In this embodiment, the cassette 201 utilizes the linear carrier 203*a* with the pins 203*c* and 203*b* for the supply spool 207 and the takeup spool 206, the linear guide 201*d* for the carrier being partly shown. A drive wheel 205 of the type described is here provided as well.

The systems described can be modified in various ways within the spirit of the invention. For example, the ramp 113, 213 can be formed by integral ribs or other means providing inclined surfaces and can be provided on the cover or the housing of the cassette. The tension springs shown can be replaced by compression or other springs suitably oriented.

We claim:

1. A cassette for a film ribbon for a type printing machine in which color is transferred from the film ribbon to a substrate, said cassette comprising:

a generally flat housing formed with guide means defining a printing region;

a carrier received in said housing and formed with a pair of pins fixedly spaced apart for respectively receiving a ribbon supply spool and a ribbon takeup spool, the ribbon passing from said supply spool over said guide means to said takeup spool, said housing being provided with a guide for said carrier for linear translational movement of said carrier in said housing;

a feed wheel received in said housing and rotatable about a fixed axis therein while bearing upon ribbon wound on said takeup spool for progressively advancing ribbon from said supply spool across said region to said takeup spool whereby the diameter of said supply spool progressively decreases and the diameter of said takeup spool progressively increases;

a spring acting on said carrier to urge said takeup spool toward said wheel;

a brake on said carrier in the form of a spring member bearing axially upon said supply spool for maintaining a drag on said supply spool to apply substantially constant tension to said ribbon at least in said region; and a ramp formed in said housing, said member bearing against said ramp for varying the force of said brake as said carrier shifts in said housing.

2. The cassette defined in claim 1 wherein said pins are provided with stubs and said guide receives said stubs.

3. The cassette defined in claim 2 wherein said wheel is toothed.

4. The cassette defined in claim 1 wherein said spring is a tension spring.

5. The cassette defined in claim 4 wherein said wheel is toothed.

6. The cassette defined in claim 1 wherein said ramp is formed with a step for relaxing the force of said brake completely at the end of the travel of said carrier in said housing.

7. The cassette defined in claim 6 wherein said wheel is toothed.

8. The cassette defined in claim 1 wherein said wheel is toothed.

* * * * *